US005620082A

United States Patent [19]

Saito

[11] Patent Number: 5,620,082

[45] Date of Patent: Apr. 15, 1997

[54] APPARATUS FOR CHANGING THE DIRECTION OF TRANSPORTATION OF ROD MEMBERS

[75] Inventor: Masayoshi Saito, Tokyo, Japan

[73] Assignee: Japan Tobacco Inc., Tokyo, Japan

[21] Appl. No.: 496,758

[22] Filed: Jun. 29, 1995

[30] Foreign Application Priority Data

Jun. 29, 1994 [JP] Japan ..... 6-147464

[51] Int. Cl.[6] ..... B65G 47/26

[52] U.S. Cl. ..... 198/624; 198/459.1

[58] Field of Search ..... 198/459.1, 459.8, 198/461.1, 461.2, 624, 478.1

[56] References Cited

U.S. PATENT DOCUMENTS

| | | | |
|---|---|---|---|
| 2,580,469 | 1/1952 | Schwartz | 198/624 X |
| 3,664,891 | 5/1972 | Shubert et al. . | |
| 3,830,355 | 8/1974 | Verjux | 198/624 |
| 3,858,708 | 1/1975 | Hollenton et al. | 198/624 X |
| 5,088,590 | 2/1992 | Marschke | 198/461.1 |

FOREIGN PATENT DOCUMENTS

| | | |
|---|---|---|
| 2371360 | 6/1978 | France . |
| 3444468 | 7/1985 | Germany . |
| 3600313 | 7/1987 | Germany . |
| 2149642 | 6/1985 | United Kingdom . |

*Primary Examiner*—James R. Bidwell

[57] ABSTRACT

A changing apparatus comprises first and second rotating disks arranged at the terminal end portion of a first transportation path which extends form a cigarette manufacturing apparatus and transports manufactured double cigarettes, pinch grooves formed individually on parts of the respective peripheral surfaces of the first and second rotating disks, and a push groove formed on the remaining portion of the first rotating disk. As the first and second rotating disks rotate, the pinch grooves accelerate a leading double cigarette on the first transportation path in a manner such that they cyclically face each other to hold the double cigarette between them. The push groove forces out the accelerated double cigarette in the transportation direction of a second transportation path in a filter attachment.

10 Claims, 8 Drawing Sheets

APPARATUS FOR CHANGING THE DIRECTION OF TRANSPORTATION OF ROD MEMBERS

BACKGROUND OF THE INVENTION

1. Field of the Invention

The present invention relates to an apparatus for feeding rod members from one of a pair of transportation paths crossing each other to the other and changing the direction of transportation of the rod members.

2. Description of the Related Art

In general, a filter cigarette manufacturing system comprises a cigarette manufacturing apparatus for manufacturing cigarettes and an attachment apparatus or so-called filter attachment for attaching filters to the manufactured cigarettes. The cigarette manufacturing apparatus forms a continuous tobacco rod in a known manner. The formed tobacco rod is cut into cigarette rods with a predetermined length in the cigarette manufacturing apparatus, and the cigarette rods are delivered toward the filter attachment.

More specifically, the manufactured cigarette rods are delivered from the cigarette manufacturing apparatus toward the filter attachment in a manner such that the respective end faces of two adjacent cigarette rods are in contact with each other. Here it is to be noted that the transportation direction and axial direction of the cigarette rods are in line with each other.

In the filter attachment, as is generally known, each of the cigarette rods is transported at right angles to its axis, and a filter is connected to an end portion of the cigarette rod in this process of transportation, whereupon a filter cigarette as a final article of commerce is obtained.

On a first transportation path for cigarette rods which extends from the cigarette manufacturing apparatus to the filter attachment, the individual cigarette rods are transported in their axial direction, as mentioned before. On a second transportation path for cigarette rods in the filter attachment, on the other hand, the cigarette rods are transported at right angles to their axial direction. Therefore, the filter cigarette manufacturing machine should be provided with a changing device for changing the direction of transportation of the cigarette rods when the cigarette rods transfer from the first transportation path to the second.

For example, a changing apparatus of this type is described in Jpn. Pat. Appln. KOKOKU Publication No. 6-56. This conventional changing apparatus comprises a deflector which feeds cigarette rods to a conveyor for use as the second transportation path. The deflector has a rotatable cam. The outer peripheral surface of the cam is formed as a cam face, which includes a first contact surface, which accelerates the cigarette rods in their axial direction along the first transportation path, and a second contact surface, which subjects the cigarette rods to a kinetic component in a direction perpendicular the axial direction, that is, in the moving direction of the conveyor.

As each of cigarette rods transported on the first transportation path passes the deflector or the rotating cam, it is therefore accelerated in its axial direction to be separated from a succeeding cigarette rod by the agency of the first contact surface of the cam. Thereafter, the cigarette rod is subjected to the kinetic component in the moving direction of the conveyor, so that it can transfer from the first transportation path to the second transportation path or the conveyor.

The first contact surface is formed as a suction face, which serves securely to accelerate the cigarette rod. More specifically, when the first contact surface is within a predetermined suction region with respect to the rotational angle of the cam, it is supplied with suction pressure. When the first contact surface is off the suction region, it is cut off from the suction pressure supply.

While the cam is rotating, therefore, the first contact surface is cyclically supplied with the suction pressure, so that noises are generated during suction pressure supply or at the time of interruption of the pressure supply.

The noise generation frequency increases in proportion to the rotating speed of the cam, thereby worsening the working atmosphere.

Additional use of soundproof equipment is needed in order to solve this problem. If the soundproof equipment is incorporated in the filter cigarette manufacturing machine, the machine becomes oversized and expensive, so that the manufacturing cost of filter cigarettes increases.

In order to secure the transfer of the cigarette rods from the cam of the deflector to the conveyor, on the other hand, fluctuation of the suction pressure supplied to the first contact surface of the cam must be restricted within an allowable range. If the operating speed of the manufacturing machine is increased, however, the fluctuation of the suction pressure on the first contact surface may augment beyond the allowable range in some cases.

This awkward situation may be removed by increasing the suction pressure supplied to the first contact surface. In this case, however, a bulky source of suction pressure is needed, and besides, and fine adjustment of the suction pressure to be supplied is not easy.

Since the perimeter of its first contact surface is fixed, moreover, the deflector cam cannot readily conform to change of the cigarette size.

SUMMARY OF THE INVENTION

The object of the present invention is to provide a transportation direction changing apparatus free from noise generation and capable of readily adapting to higher-speed operation, compact design, and change of the size of rod members.

The above object is achieved by a changing apparatus according to the present invention, which comprises: first and second rotating members arranged at the terminal end portion of a first transportation path for transporting rod members and rotatable in opposite directions, the first and second rotating members individually having peripheral surfaces facing each other such that the opposite peripheral surfaces move in the direction of transportation of the rod members on the first transportation path; accelerating means for accelerating a leading rod member on the first transportation path, thereby separating the leading rod member from a succeeding rod member, as the first and second rotating members rotate, the accelerating means including first and second pinch faces formed on part of the peripheral surfaces of the first and second rotating members, respectively, the first and second pinch faces being adapted cyclically to face each other across the first transportation path, thereby defining an acceleration hole for seizing the leading rod member, and having a moving speed higher than the speed of transportation of the rod members on the first transportation path; and deflecting means for subjecting the accelerated rod member to a transverse kinetic component along the second transportation path as the first and second rotating members rotate, the deflecting means including a push face formed on the remaining portion of the peripheral surface of the first rotating member and a relief face formed on the remaining portion of the peripheral surface of the second rotating member, the push face being adapted to force out the accelerated rod member in the transportation direction of the second transportation path, the relief face allowing the accelerated rod member to be forced out.

According to the changing apparatus described above, when the leading rod member on the first transportation path reaches a position between the first and second rotating members, it is held between the respective pinch faces of the first and second rotating members, and is accelerated as the pinch faces move. Thereupon, the rod member is separated from the succeeding rod member.

Thereafter, the accelerated rod member is forced out in the transportation direction of the second transportation path by the push face of the first rotating member. Accordingly, the accelerated rod member is subjected to the transverse kinetic component corresponding to the transportation speed of the second transportation path, so that the transportation direction of the rod member is deflected, whereupon the rod member can transfer to the second transportation path.

Since suction pressure is not used to accelerate the rod members, according to the changing apparatus of the invention, a suction pressure source need not be used, and there is no possibility of generation of noises attributable to suction pressure supply or interruption thereof. Thus, the changing apparatus does not require use of any soundproof equipment.

If the respective pinch faces of the first and second rotating members are formed of grooves with an arcuate cross section, satisfactory contact surfaces can be secured between the pinch faces and the rod member. Thus, slipping between the pinch faces and the rod member can be prevented, so that the rod member can be accelerated securely.

The changing apparatus of the invention may further comprise second deflecting means for further continuing to subject the accelerated rod member to the transverse kinetic component. In this case, the deflecting means includes a third rotating member, arranged in parallel with the first rotating member on the down or upper stream side thereof with respect to the first transportation path and rotatable in the same direction with the first rotating member, and a second push face formed on part of the peripheral surface of the third rotating member.

When the deflected rod member is received on the third rotating member, the second push face thereof forces out the rod member continuously in the transportation direction of the second transportation path as the third rotating member rotates, thereby allowing the rod member to transfer to the second transportation path with higher reliability.

In the case that the third rotating member is arranged on the down stream side of the first rotating member, the second deflecting means may further include a guide face formed on part of the peripheral surface of the third rotating member. In this case, the rod member is supported by the first pinch face of the first rotating member and the guide face of the third rotating member when it is accelerated by the first and second pinch faces. Thus, the rod member can be accelerated in a stable posture.

Preferably, the second push face and the guide face of the third rotating member are each formed of a groove with an arcuate cross section.

The changing apparatus of the invention may further comprise adjusting means for adjusting the distance between the first and second rotating members. If the diameter of the rod members is changed, therefore, the diameter of the acceleration hole can be adjusted in accordance with the change.

The changing apparatus of the invention may further comprise second adjusting means for adjusting the distance between the first and third rotating members. If the length of the rod members is changed, therefore, the timing for the second push face of the third rotating member to function can be adjusted in accordance with the change of the length.

Further preferably, the third rotating member is movable in a direction crossing the first transportation path. If the change of the rod member size requires replacement of the first to third rotating members, in this case, the replacement can be accomplished with ease.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus, are not limitative of the present invention, and wherein.

DETAILED DESCRIPTION OF THE PREFERRED EMBODIMENTS

Figure 1:
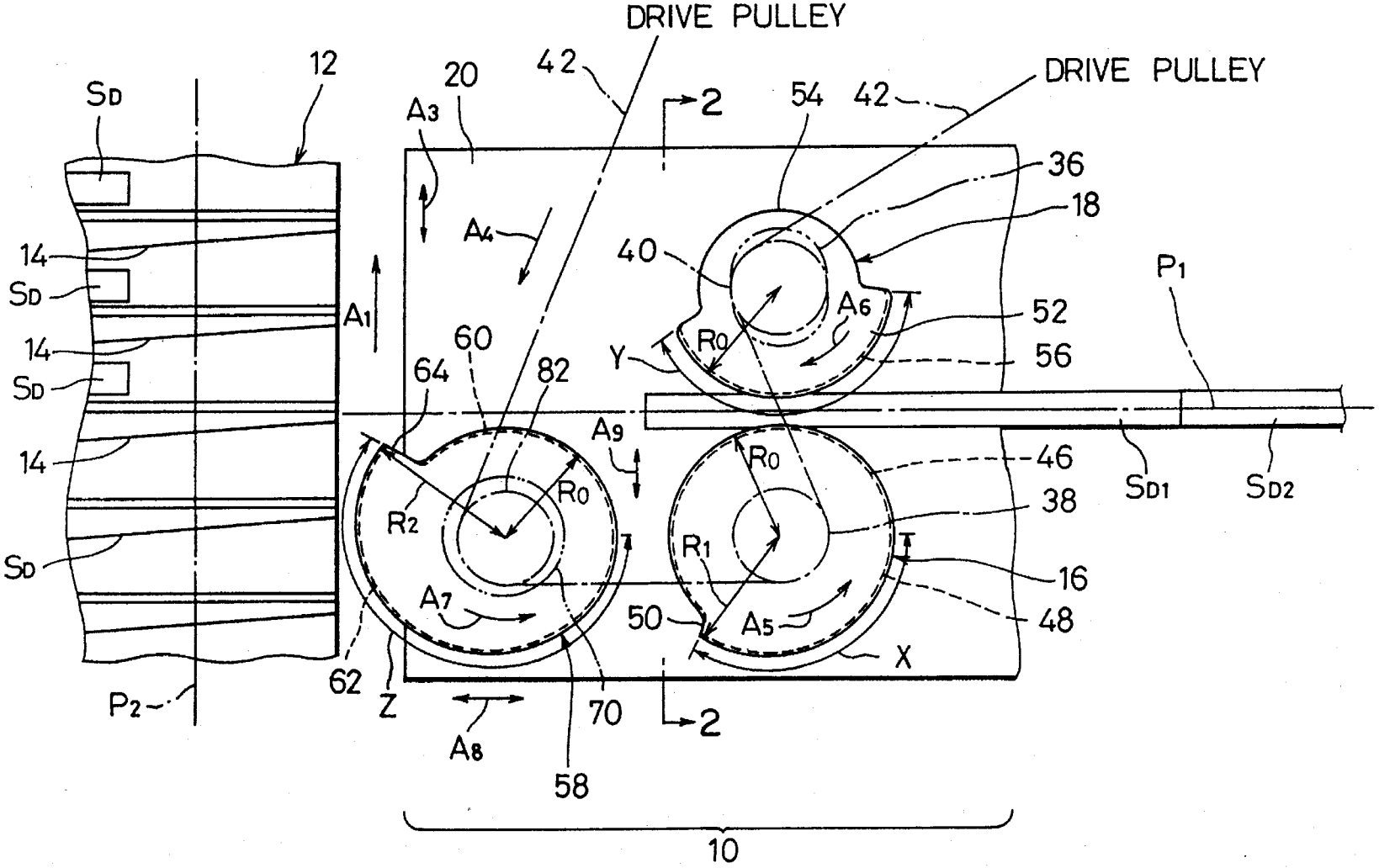
FIG. 1 is a plan view showing a changing apparatus according to one embodiment of the present invention.

Referring to FIG. 1, there is shown an apparatus for changing the transportation direction of cigarette rods. The changing apparatus 10 is located at the terminal end portion of a first transportation path $P_1$ which extends from a cigarette manufacturing apparatus (not shown). In FIG. 1, the transportation path $P_1$ is indicated by dashed line. The cigarette manufacturing apparatus forms a continuous tobacco rod by wrapping cut tobacco in wrapping paper in a conventional manner. The formed tobacco rod is cut into double cigarettes $S_D$ with a predetermined length. Each of the double cigarette $S_D$ is twice as long as a cigarette portion of a filter cigarette.

Thereafter, the double cigarettes $S_D$ are fed to the first transportation path $P_1$ and transported thereon. More specifically, two adjacent double cigarettes $S_D$ are transported on the transportation path $P_1$ with their end faces abutting against each other.

The terminal end of the first transportation path $P_1$ is situated in the vicinity of a drum train of a filter attachment. The drum train constitutes part of a second transportation path $P_2$ in the filter attachment. In FIG. 1, the transportation path $P_2$ is indicated by dashed line. The drum train includes a plurality of grooved drums. Illustrated in FIG. 1 is only part of a grooved drum which is situated at the starting end of the drum train, that is, part of the outer peripheral surface of a catcher drum 12.

The catcher drum 12 has a large number of transportation grooves 14 arranged at regular intervals on its outer peripheral surface. The rotating direction of the catcher drum 12 or the transportation direction of the drum train is indicated by arrow $A_1$ in FIG. 1.

As seen from FIG. 1, the transportation direction $A_1$ (second transportation path $P_2$) of the drum train and the first transportation path $P_1$ are at right angles to each other.

When a double cigarette $S_D$ is fed to one transportation groove 14 of the catcher drum 12, it is transported toward an adjacent grooved drum in the drum train and transfers to one transportation groove of the grooved drum as the catcher drum 12 rotates. Thereafter, the double cigarette $S_D$ transfers to the adjacent grooved drums in the drum train in succession as it is transported toward a rolling section of the filter attachment. In this process of transportation, each of the double cigarettes $S_D$ is cut into a pair of equal single cigarettes, whereupon a predetermined space is secured between the two single cigarettes.

In the case where the single cigarettes are formed in the cigarette manufacturing apparatus, the single cigarettes delivered to the catcher drum 12 are subjected to grading in the process of its transportation. On the drum train, therefore, a pair of single cigarettes are transported side by side on the same axis with each other, and the predetermined space is secured between them.

On the drum train, moreover, a filter plug is fed to the space between each pair of single cigarettes, and the filter plug and the paired single cigarettes are supplied to the rolling section. In the rolling section, the pair of single cigarettes and the filter plug are connected to one another by being wound with tip paper pieces, whereupon a double filter cigarette is completed.

Thereafter, the double filter cigarette is fed to a second drum train, which extends from the rolling section, and is transported thereon. In this process of transportation, each of double filter cigarettes is cut in the center to be reduced to two equal filter cigarettes.

The changing apparatus 10 comprises first and second rotating disks 16 and 18. The rotating disks 16 and 18 are arranged horizontally, and their respective outer peripheral surfaces face each other with the first transportation path $P_1$ between them. The first and second rotating disks 16 and 18 are rotatably mounted on a mounting plate 20.

Figure 2:
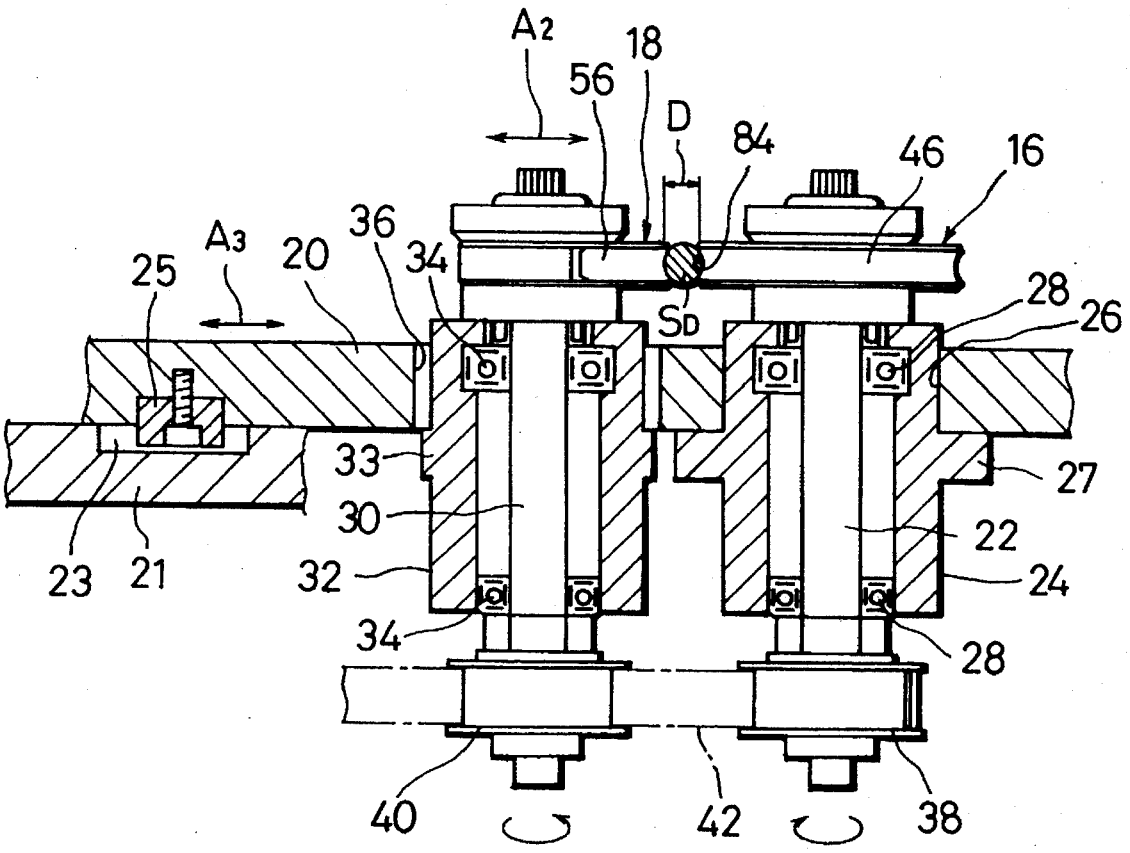
FIG. 2 is a sectional view taken along line 2—2 of FIG. 1.

More specifically, the first rotating disk 16 has a shaft 22, as shown in FIG. 2. The shaft 22 extends downward and penetrates a fixed sleeve 24. The fixed sleeve 24 has a flange 27 and is mounted on the lower surface of the mounting plate 20 by means of the flange 27 thereof in a manner such that its upper portion is fitted in a hole 26 in the plate 20. A pair of bearings 28 are arranged vertically in the fixed sleeve 24, and support the shaft 22 of the first rotating disk 16 for rotation.

On the other hand, the second rotating disk 18 also has a shaft 30, which extends downward and penetrates a movable sleeve 32. A pair of bearings 34 are arranged vertically in the movable sleeve 32, and support the shaft 30 of the second rotating disk 18 for rotation.

The movable sleeve 32 has a flange 33 and is movably mounted on the mounting plate 20. More specifically, the mounting plate 20 is formed with a slot 36, and the upper portion of the movable sleeve 32 is fitted in the slot 36. The movable sleeve 32 is mounted on the lower surface of the mounting plate 20 by means of the flange 33 thereof.

The slot 36 extends at right angles to the first transportation path $P_1$, and the movable sleeve 32, that is, the second rotating disk 18, can shift its position in the direction indicated by arrow $A_2$ in FIG. 2. Thus, the second rotating disk 18 can move toward and away from the first rotating disk 16, whereby a space D between the first and second rotating disks 16 and 18 can be adjusted.

The mounting plate 20 is mounted on a base 21, and is movable in the direction indicated by arrow $A_3$. The upper surface of the base 21 is formed with a guide groove 23 which extends in the direction of arrow $A_3$. Fitted in the guide groove 23 is a slide key 25 which is fixed to the underside of the mounting plate 20.

Thus, the mounting plate 20 is movable in the direction of arrow $A_3$ on the base 21, so that the center of the space D between the first and second rotating disks 16 and 18 can be accurately situated on the first transportation path $P_1$.

If the first rotating disk 16, like the second rotating disk 18, is movably mounted on the mounting plate 20 in the direction of arrow $A_2$, the plate 20 need not be movable with respect to the base 21.

Pulleys 38 and 40 are mounted on the lower ends of the shafts 22 and 30 of the first and second rotating disks 16 and 18., respectively, and a drive belt 42 (indicated by dashed line) is passed around and between the pulleys 38 and 40.

FIG. 1 clearly shows the way the drive belt 42 is passed around the pulleys 38 and 40. The belt 42 is subjected to the rotatory force of a drive pulley, and travels in one direction, that is, in the direction indicated by arrow $A_4$ in FIG. 1, thereby causing the first and second rotating disks 16 and 18 to rotate in opposite directions. The rotating directions of the rotating disks 16 and 18 are indicated by arrows $A_5$ and $A_6$, respectively, in FIG. 1.

As seen from FIG. 1, the first rotating disk 16 has a volute profile, and is formed with a circumferential groove on its outer peripheral surface. This circumferential groove has an arcuate cross section.

The circumferential groove of the first rotating disk 16 includes a pinch groove 46 and a push groove 48. The bottom of the pinch groove 46 extends on the circumference of a circle with a fixed radius $R_0$ around the center of the first rotating disk 16. The push groove 48 has one end which is connected to the pinch groove 46 by means of a step 50. The distance between the bottom of the push groove 48 and the center of the first rotating disk 16 is gradually reduced in the rotating direction $A_5$ of the disk 16 so that the respective bottoms of the push groove 48 and the pinch groove 46 are connected continuously or smoothly. The push groove 48 extends covering a region X in the circumferential direction of the first rotating disk 16, and a distance $R_1$ between the one end of the groove 48 and the center of the disk 16 is longer than the radius $R_0$.

On the other hand, the profile of the second rotating disk 18 includes a large-diameter portion 52 and a small-diameter portion 54, which are connected to each other by means of two steps. The large diameter portion 52 extends covering a region Y in the circumferential direction of the second rotating disk 18, and is formed with a pinch groove 56. The groove 56 has an arcuate cross section. The bottom of the pinch groove 56 extends on the circumference of a circle with the radius $R_0$ around the center of the second rotating disk 18.

Further, the changing apparatus 10 comprises a third rotating disk 58, which is arranged horizontally and situated on the down stream side of the first rotating disk 16 with respect to the first transportation path $P_1$. The third rotating disk 58 is rotatably mounted on the mounting plate 20, as mentioned later, and can be rotated in the direction indicated by arrow $A_7$ in FIG. 1.

The third rotating disk 58, like the first rotating disk 16, has a volute profile, and is formed with a circumferential groove on its outer peripheral surface. This circumferential groove has an arcuate cross section. The circumferential groove of the third rotating disk 58 includes a guide groove 60 and a push groove 62. The bottom of the guide groove 60 extends on the circumference of a circle with the radius $R_0$ around the center of the third rotating disk 58. The push groove 62 has one end which is connected to the guide groove 60 by means of a step 64. The distance between the bottom of the push groove 62 and the center of the third rotating disk 58 is gradually reduced in the rotating direction $A_7$ of the disk 58 so that the respective bottoms of the push groove 62 and the guide groove 60 are connected continuously or smoothly. The push groove 62 extends covering a region Z in the circumferential direction of the third rotating disk 58, and a distance $R_2$ between the one end of the groove 62 and the center of the disk 58 is longer than the distance $R_1$.

Figure 3:
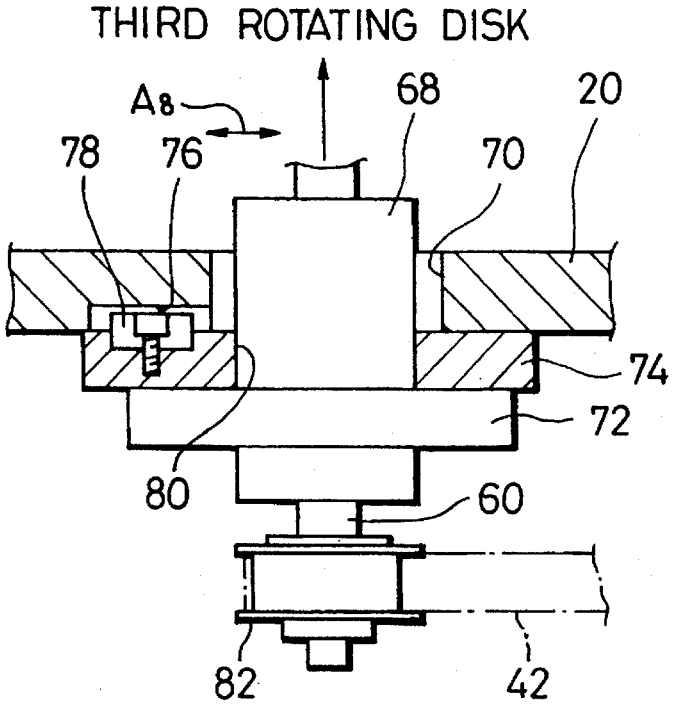
FIG. 3 is a cutaway view showing a supporting structure for a third rotating disk shown in FIG. 1.
Figure 4:
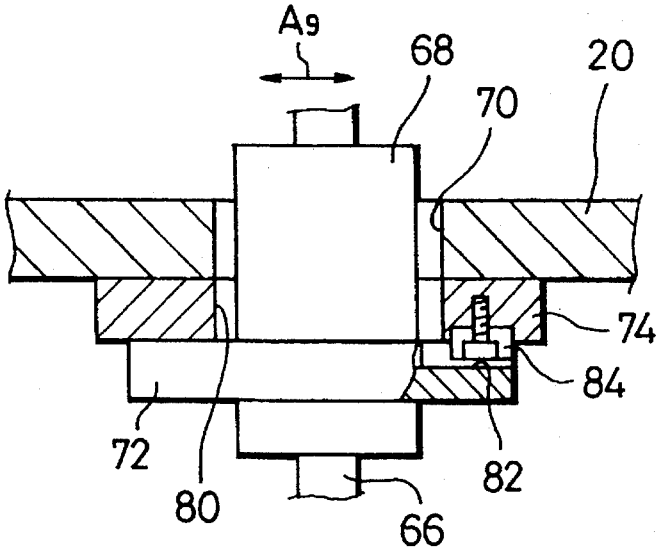
FIG. 4 is a cutaway view showing the supporting structure.

Referring to FIGS. 3 and 4, there is shown an arrangement for mounting the third rotating disk 58 on the mounting plate 20. The third rotating disk 58 also has a shaft 66, which extends downward through a movable sleeve, and is rotatably supported by means of a pair of bearings (not shown) in the sleeve 68. The movable sleeve 68 has a flange 72 and the upper portion of the movable sleeve 68 is loosely fitted in a hole 70 in the mounting plate 20. The flange 72 of the movable sleeve 68 is attached to the lower surface of the mounting plate 20 by means of an intermediate ring 74.

As shown in FIG. 3, the lower surface of the mounting plate 20 is formed with a guide groove 76, which is fitted with a slide key 78 which is fixed to the intermediate ring 74. The guide groove 76 extends in the direction of arrow $A_8$ along the first transportation path $P_1$. Thus, the intermediate ring 74, accompanied by the movable sleeve 68 or the third rotating disk 58, can move in the direction of arrow $A_8$ with respect to the mounting plate 20. As seen from FIG. 1, therefore, the third rotating disk 58 can move toward and away from the first rotating disk 16, whereby the distance between the first and third rotating disks 16 and 58 can be adjusted.

As seen from FIGS. 3 and 4, moreover, the movable sleeve 68 penetrates a slot 80 in the intermediate ring 74. The slot 80 extends in the direction of arrow $A_9$ at right angles to the first transportation path $P_1$. The upper surface of the flange 72 of the movable sleeve 68 is formed with a guide groove 82 which extends in the direction of arrow $A_9$. Fitted in the guide groove 82 is a slide key 84 which is fixed to the underside of the intermediate ring 74. Thus, the movable sleeve 68 can move in the direction of arrow $A_9$ with respect to the intermediate ring 74, so that the third rotating disk 58 can move toward and away from the first transportation path $P_1$. In consequence, a line which connects the respective centers of the first and third rotating disks 16 and 58 can be adjusted so as to be parallel to the first transportation path $P_1$.

As shown in FIG. 3, a pulley 82 is mounted on the lower end of the shaft 66 of the third rotating disk 58, and the drive belt 42 is passed around the pulley 82. FIG. 1 clearly shows the direction in which the drive belt 42 is passed around the pulley 82. Thus, the third rotating disk 58 is rotated in synchronism with the first and second rotating disks 16 and 18. The first, second, and third rotating disks 16, 18 and 58 are rotated at the same speed. The moving speeds of the respective pinch grooves 46 and 56 of the first and second rotating disks 16 and 18 are higher than the speed of transportation of the double cigarettes $S_D$ on the first transportation path $P_1$.

When the first and second rotating disks 16 and 18 are rotated in the opposite directions, as mentioned before, their respective pinch grooves 46 and 56 cyclically face with the first transportation path $P_1$ between them, whereupon they define an acceleration hole 84 which is coaxial with the path $P_1$ (see FIG. 2).

The diameter of the acceleration hole 84 is a little smaller than that of the double cigarettes $S_D$ transported on the first transportation path $P_1$. Even though one double cigarette $S_D$ is held between the pinch grooves 46 and 56, however, a moderate frictional force is produced between the cigarette $S_D$ and the grooves 46 and 56 without crushing the cigarette $S_D$. The diameter of the acceleration hole 84 can be adjusted depending on that of the double cigarettes $S_D$ by moving the second rotating disk 18 in the aforesaid manner.

Figure 5:
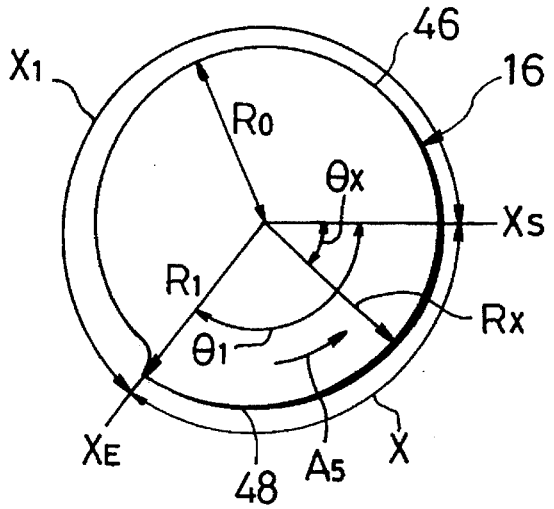
FIG. 5 is a diagram for illustrating a region X of a first rotating disk shown in FIG. 1.
Figure 6:
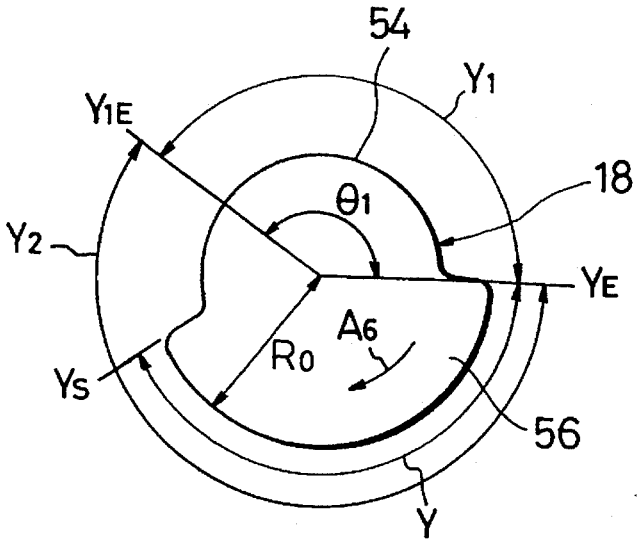
FIG. 6 is a diagram for illustrating a region Y of a second rotating disk shown in FIG. 1.
Figure 7:
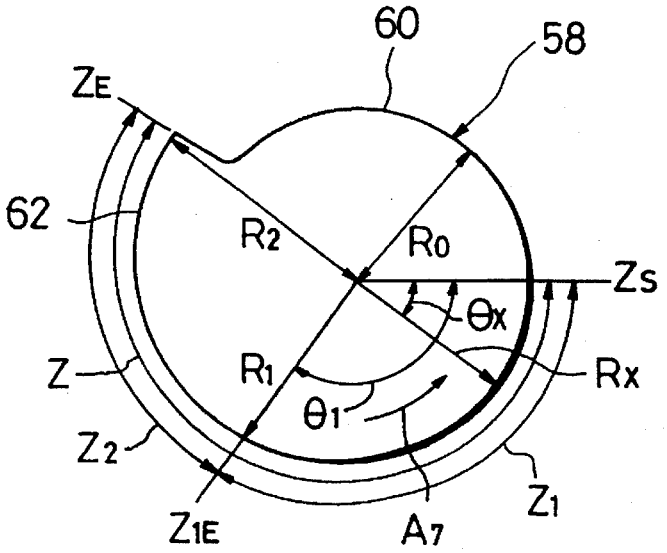
FIG. 7 is a diagram for illustrating a region Z of a third rotating disk shown in FIG. 1.

Referring now to FIGS. 5 to 7, the regions X, Y and Z for the push groove 48 of the first rotating disk 16, the pinch groove 56 of the second rotating disk 18, and the push groove 62 of the third rotating disk 58 will be described.

While the first and second rotating disks 16 and 18 are rotating, the push groove 48 of the first disk 16 and the pinch groove 56 of the second disk 18 never face each other with the first transportation path $P_1$ between them. More specifically, when a starting end $X_S$ (see FIG. 5) of the region X (push groove 48) comes closest to the first transportation path $P_1$ with respect to the rotating direction $A_5$ of the first rotating disk 16, the region Y (pinch groove 56) of the second rotating disk 18 is in a state such that its terminal end $Y_E$ (see FIG. 6) has just or already passed the first transportation path $P_1$ in the rotating direction $A_6$ of the second rotating disk 18.

When the respective rotations of the first and second rotating disks 16 and 18 advance, thereafter, the region X (push groove 48) of the first rotating disk 16 faces a region $Y_1$ (see FIG. 6) of the small-diameter portion 54 of the second rotating disk 18. The regions X and $Y_1$ have the same rotational angle $\theta_1$ with respect to the respective centers of the first and second rotating disks 16 and 18.

When the rotations of the first and second rotating disks 16 and 18 further advance, the region $X_1$ (pinch groove 46) faces a region $Y_2$ of the second rotating disk 18 which ranges from a terminal end $Y_{1E}$ of the region $Y_1$ to the terminal end $Y_E$ of the region Y. Since the region $Y_2$ covers the region Y, the regions $X_1$ and Y (pinch grooves 46 and 56) face each other. The acceleration hole 84 is maintained while the pinch grooves 46 and 56 face each other.

A starting end $Z_S$ of the region Z (push groove 62) of the third rotating disk 58, with respect to the rotating direction $A_7$ of the disk 58, moves in synchronism with the starting end $X_S$ of the region X (push groove 48) of the first rotating disk 16. Thus, the starting ends $X_S$ and $Z_S$ of the regions X and Z simultaneously approach the first transportation path $P_1$. Since the region Z is wider than the region X, so that the region Z is in the first transportation path $P_1$ even after the path $P_1$ is passed by the terminal end $X_E$ of the region X. More specifically, the region Z covers a region $Z_1$ which corresponds to the region X, as shown in FIG. 7. After the region $Z_1$ passes the first transportation path $P_1$, the remaining portion of the region Z, that is, a region $Z_2$ ranging from a terminal end $Z_{1E}$ of the region $Z_1$ to a terminal end $Z_E$ of the region Z, passes the path $P_1$.

Hereupon, it is noted that the distance between the terminal end $Z_{1E}$ of the region Z and the center of the third rotating disk 58 is equal to the distance $R_1$ between the terminal $X_E$ of the region X and the center of the first rotating disk 16. More specifically, as shown in FIG. 5 and 7, if points on the region X and Z has a same rotational angle$\theta$X from the terminals $X_S$ and $Z_S$, respectively, the distances between the points and the centers of the disk 16 and 58 are equal to a same distance $R_X$.

Referring now to FIGS. 8 to 14, the operation of the aforementioned changing apparatus 10 will be described.

Figure 8:
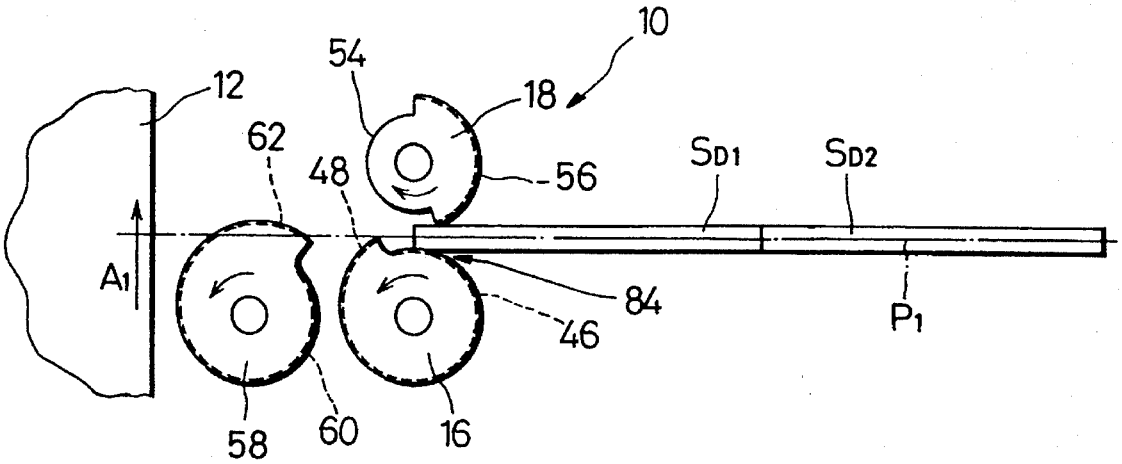
FIG. 8 is a schematic view showing a state in which a lead double cigarette on a first transportation path is starting to be held between first and second rotating disks.

First, the double cigarettes (hereinafter referred to simply as cigarettes) $S_D$ manufactured by means of the cigarette manufacturing apparatus are transported in a manner such that the respective end faces of two adjacent cigarettes $S_D$ abut against each other on the first transportation path $P_1$, as shown in FIG. 8.

When a lead cigarette $S_{D1}$ on the first transportation path $P_1$ reaches the changing apparatus 10, the pinch grooves 46 and 56 of the first and second rotating disks 16 and 18 start to face each other, whereupon the acceleration hole 84 is formed between the disks 16 and 18. Thus, the lead cigarette $S_{D1}$ gets into the acceleration hole 84, and is held between the pinch grooves 46 and 56.

Figure 9:
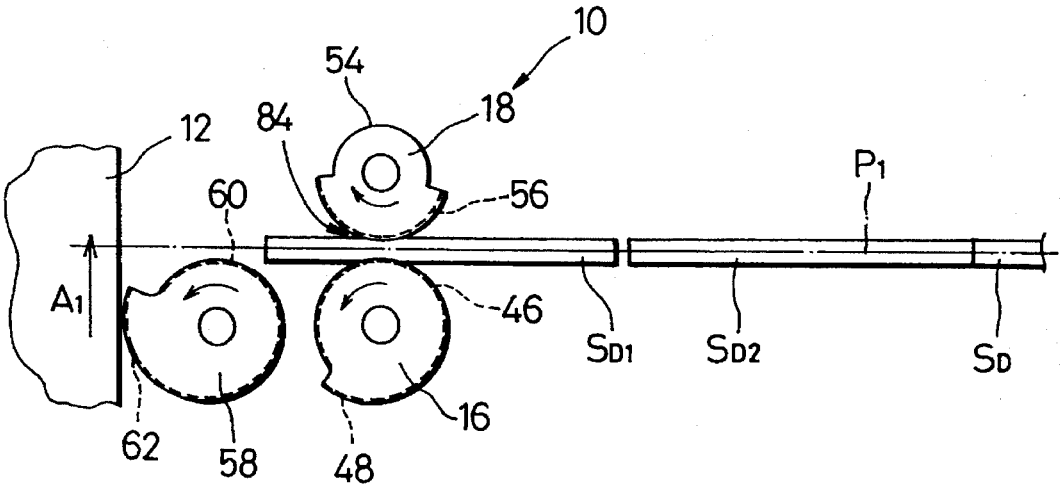
FIG. 9 is a schematic view showing a state in which the lead double cigarette is being accelerated by the first and second rotating disks.

Since the moving speeds of the pinch grooves 46 and 56, which define the acceleration hole 84, are higher than the speed of transportation of the cigarettes $S_D$ on the first transportation path $P_1$, as mentioned before, the cigarette $S_{D1}$ is accelerated in its axial direction as the pinch grooves 46 and 56 move. Accordingly, the cigarette $S_{D1}$ is separated from a succeeding cigarette $S_{D2}$, as shown in FIG. 9.

Figure 10:
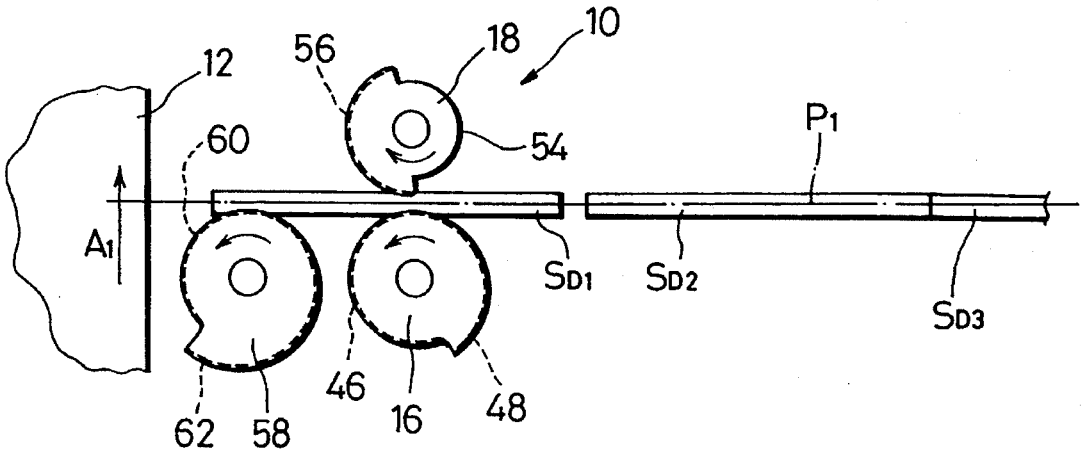
FIG. 10 is a schematic view showing a state after the acceleration of the double cigarette is finished.
Figure 11:
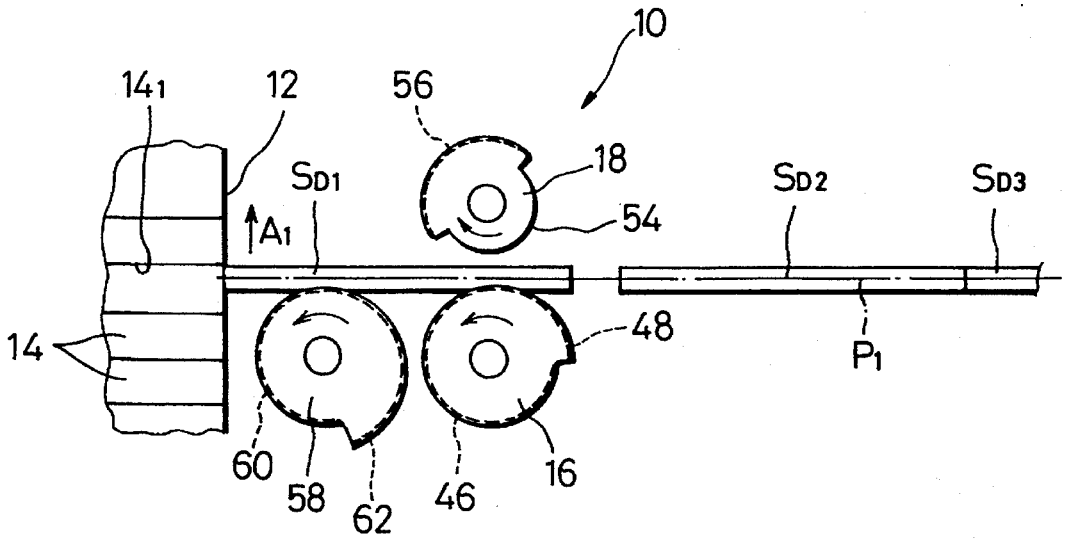
FIG. 11 is a schematic view showing a state just before the double cigarette is forced out in the transportation direction of a second transportation path.

When the rotations of the first and second rotating disks 16 and 18 further advance, the pinch groove 56 of the second rotating disk 18 leaves the cigarette $S_{D1}$ and the cigarette $S_{D1}$ transfers from the pinch groove 46 of the first rotating disk 16 to the push groove 48, as shown in FIG. 10. When the leading end portion of the cigarette $S_{D1}$ reaches on the third rotating disk 58, the tailing end portion of the cigarette $S_{D1}$ is still received on the pinch groove 46 of the first rotating disk 16. Thus, the cigarette $S_{D1}$ is supported on the guide groove 60 of the third rotating disk 58 and the pinch groove 46 of the first rotating disk 16. Thereafter, when the cigarette $S_{D1}$ transfers from the pinch groove 46 of the first rotating disk 16 to the push groove 48, the leading end portion of the cigarette $S_{D1}$ is received by the push groove 62 of the third rotating disk 58. This process of operation can be achieved by properly adjusting the synchronization for the rotation of first and third rotating disk 16 and 58 and the distance between the disks 16 and 58.

Thereafter, the leading and trailing end portions of the cigarette $S_{D1}$ are supported in the push grooves 62 and 48 of the third and first rotating disks 58 and 16, respectively, and the leading end of the cigarette $S_{D1}$ reaches the inlet of one transportation groove 141 of the catcher drum 12.

Figure 12:
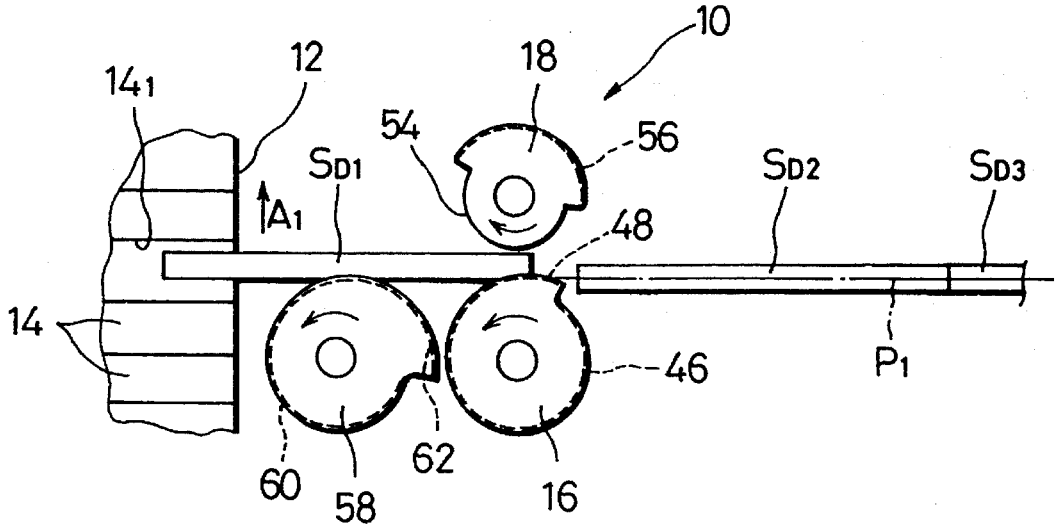
FIG. 12 is a schematic view showing the way the double cigarette is forced out by a push groove of the first rotating disk.

As the first and third rotating disks 16 and 58 rotate, the distances between the respective bottoms of the push grooves 48 and 62 and the respective centers of the rotating disks 16 and 58 increase, so that the cigarette $S_{D1}$ is forced out in the transverse direction of the first transportation path $P_1$, that is, in the rotating direction $A_1$ of the catcher drum 12, as shown in FIG. 12. Thereupon, the cigarette $S_{D1}$ is subjected to a transverse kinetic component. By this time, the leading end of the cigarette $S_{D1}$ will have already got into the transportation groove $\mathbf{14}_1$ of the catcher drum 12.

As mentioned before, the push groove 48 of the first rotating disk 16 corresponds to the region $Z_1$ of the push groove 62 of the third rotating disk 58. Accordingly, the cigarette $S_{D1}$ is forced out in a direction perpendicular to the first transportation path $P_1$ without changing its parallel relation with the path $P_1$. At this time, the small-diameter portion 54 of the second rotating disk 18 is kept opposite to the first transportation path $P_1$, so that an adequate space is secured between the first and second rotating disks 16 and 18. Thus, the second disk 18 never hinders the transverse movement of the cigarette $S_{D1}$.

Figure 13:
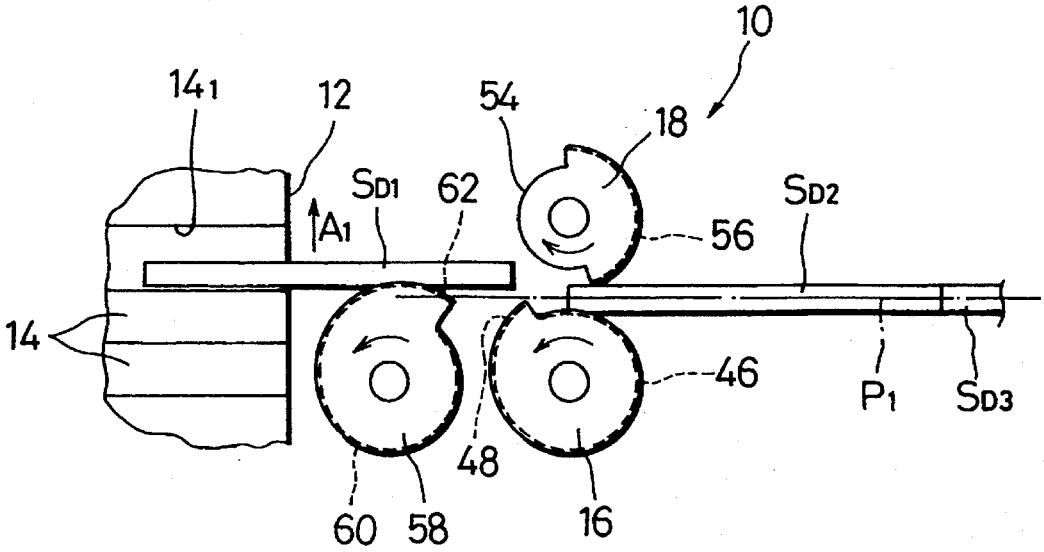
FIG. 13 is a schematic view showing the way the double cigarette is further forced out by a push groove of the third rotating disk.

Even when the first rotating disk 16 is passed entire by the trailing end of the cigarette $S_{D1}$, as shown in FIG. 13, thereafter, the cigarette $S_{D1}$ is still supported by the push groove 62 of the third rotating disk 58. As the third disk 58 rotates, therefore, the cigarette $S_{D1}$ continues to be subjected to the transverse kinetic component, whereupon it is directed to the transportation groove $\mathbf{14}_1$ of the catcher drum 12 without changing its stable posture.

Figure 14:
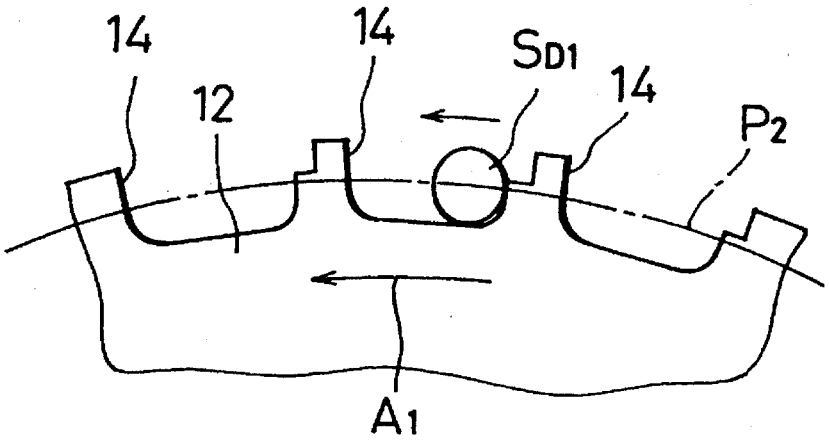
FIG. 14 is a schematic view showing part of a catcher drum in a filter attachment.

Thus, when the leading end of the cigarette $S_{D1}$ gets into the transportation groove $\mathbf{14}_1$, it is subjected to the kinetic component in the moving direction of the transportation groove $\mathbf{14}_1$, so that it is securely received by the groove $\mathbf{14}_1$, as shown in FIG. 14. In consequence, the cigarette $S_{D1}$ cannot be rubbed against the inlet of the transportation groove $\mathbf{14}_1$, and can be prevented from being damaged.

When the cigarette $S_{D1}$ is received by the catcher drum 12, the succeeding cigarette $S_{D2}$ reaches the position of the cigarette $S_{D1}$ shown in FIG. 8, and thereafter, it is also received by the catcher drum 12 in like manner.

According to the changing apparatus 10 described above, suction pressure is not used to accelerate the cigarettes $S_D$, so that generation of noises attributable to suction pressure supply or interruption thereof can be prevented. Thus, the changing apparatus 10 according to the present invention does not require use of a suction pressure source or soundproof equipment. As a result, the changing apparatus 10 never entails an increase in the overall size of the filter cigarette manufacturing machine or in the manufacturing cost of the machine or filter cigarettes.

Figure 15:
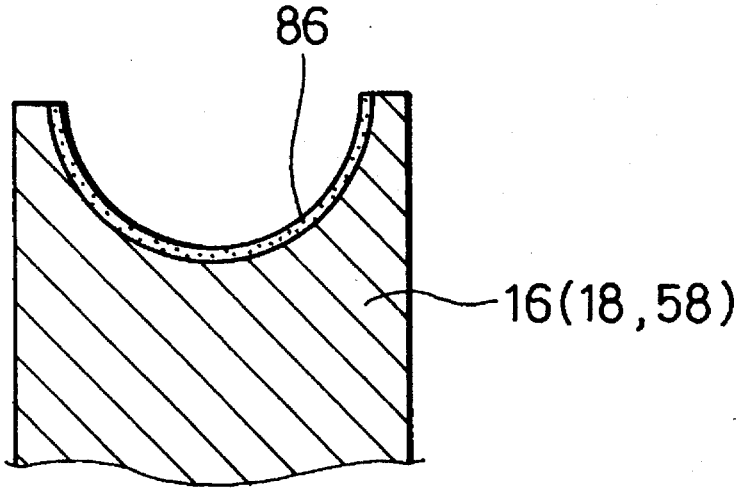
FIG. 15 is a cross-sectional view showing a circumferential groove of any of first to third rotating disks.

In each of the first to third rotating disks 16, 18 and 58, as shown in FIG. 15, a high-friction coating layer 86 may be formed on the respective inner surfaces of its pinch groove, push groove, and guide groove. The coating layer 86 serves to prevent slipping of the cigarettes $S_D$, thereby ensuring more reliable acceleration and transportation of the cigarettes $S_D$.

If the cigarette size is changed, the changing apparatus 10 can readily adapt to it.

If the diameter of the cigarette is changed, for example, the second rotating disk 18 is moved at right angles to the first transportation path $P_1$, and the space D between the first and second rotating disks 16 and 18, that is, the diameter of the acceleration hole 84, is adjusted depending on the diameter of new cigarettes. More specifically, this adjustment is made by using a sample rod whose diameter is a little smaller than that of the new cigarettes. The second rotating disk 18 is moved so that the sample rod is held between the respective pinch grooves 46 and 56 of the first and second rotating disks 16 and 18. The mounting plate 20 is also moved at right angles to the first transportation path $P_1$, whereupon the adjusted acceleration hole 84 is situated coaxially with the path $P_1$.

If the length of the cigarettes is changed, the third rotating disk 58 is moved along the first transportation path $P_1$, whereby the distance between the first and third rotating disks 16 and 58 is adjusted.

In the case where the change of the length is substantial, however, the first to third rotating disks may possibly require replacement. More specifically, if the cigarette length is increased, the rod speed (cigarette length/transportation cycle) of the cigarettes transported on the first transportation path $P_1$ increases correspondingly. If the cigarettes become shorter, on the other hand, the rod speed decreases. As seen from FIGS. 8 and 13, the leading end of the succeeding cigarette must have reached the same position for the leading end of the preceding cigarette, without regard to the cigarette length, by the time when the first and second rotating disks 16 and 18 have made one revolution each.

However, the acceleration of the cigarettes by means of the first and second rotating disks 16 and 18 depends on the peripheral speeds of the disks 16 and 18 or the moving speeds of the pinch grooves 46 and 56. In the case where the first and second disks 16 and 18 have the same size, therefore, the acceleration ratio of the cigarettes compared with the rod speed decreases if the cigarettes become longer, and increases if the cigarettes become shorter.

If the acceleration changes substantially, the catcher drum 12 is disabled from receiving the cigarettes. Therefore, the variation of the acceleration ratio should be restricted within a fixed range.

In the case where the first and second rotating disks 16 and 18 are adapted for long cigarettes, the distance between the first and third rotating disks 16 and 58 is inevitably extended without giving consideration to the acceleration ratio. Thus, if the cigarettes to be handled are relatively short, the support of the cigarettes between the first and third rotating disks may becomes unstable, or the cigarettes may fail to make a straight advance.

If the change of the cigarette length is small (e.g., several millimeters), therefore, the first to third rotating disks may be used in common. If the change is substantial, however, the rotating disks should be replaced with ones which are suited for the cigarette length.

According to the changing apparatus 10 of the present invention, however, the space between the first and second rotating disks, as mentioned before, so that the rotating disks can be replaced with ease.

Since the third rotating disk 58 is located on the down stream side of the first and second rotating disks 16 and 18, moreover, adequate spaces can be secured between the catcher drum 12 and the disks 16 and 18. In this case, the timing for the acceleration of the cigarettes is advanced, so that the speed of transportation of the cigarettes is already stabilized by the time when the cigarettes are received by the catcher drum 12. Thus, the timing for the cigarette supply to the catcher drum 12 can be adjusted readily, so that the drum 12 can securely receive the cigarettes.

The third rotating disk 58 may be located on the upper stream side of the first and second rotating disks 16 and 18. In order to avoid interference between the small-diameter portion 54 of the second rotating disk 18 and the cigarette, in this case, the region Z (push groove 62) of the third rotating disk 58 must be made narrower than the region X (push groove 46) of the first rotating disk 16 (X>Z).

If the acceleration of the cigarette and the application of the transverse kinetic component to the cigarette are achieved by means of the first and second rotating disks 16 and 18 only, however, the third rotating disk 58 serves as guide means for guiding the cigarette in transportation. In this case, the region X of the first rotating disk 16 is widened, so that the radius of the small-diameter portion 54 of the second rotating disk 18 should be reduced correspondingly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for feeding rod members from a first transportation path onto a second transportation path which crosses the first transportation path and changing the direction of transportation of the rod members, in which the rod members are transported along the first transportation path in a manner such that the respective end faces of two adjacent rod members abut against each other on the first transportation path, and are transported on the second transportation path in a manner such that their respective axes extend at right angles to the second transportation path, said apparatus comprising:

first and second rotating members arranged at a terminal end portion of the first transportation path and rotatable in opposite directions, said first and second rotating members individually having peripheral surfaces facing each other such that the opposite peripheral surfaces move in the direction of transportation of the rod members on the first transportation path;

accelerating means for accelerating a leading rod member on the first transportation path, thereby separating said leading rod member from a succeeding rod member, as said first and second rotating members rotate, said accelerating means including first and second pinch faces formed on part of the peripheral surfaces of said first and second rotating members, respectively, the first and second pinch faces being adapted cyclically to face each other across the first transportation path, thereby defining an acceleration hole for seizing the leading rod member, and having a moving speed higher than the speed of transportation of the rod members on the first transportation path; and deflecting means for subjecting the accelerated rod member to a transverse kinetic component along the second transportation path as said first and second rotating members rotate, said deflecting means including a push face formed on the remaining portion of the peripheral surface of the first rotating member and a relief face formed on the remaining portion of the peripheral surface of the second rotating member, the push face being adapted to force out the accelerated rod member in the transportation direction of the second transportation path, the relief face allowing the accelerated rod member to be forced out, wherein said first rotating member has a first circumferential groove with an arcuate cross section on the peripheral surface thereof, the first circumferential groove forming the first pinch face and the push face, and said second rotating member has a second circumferential groove on part of the peripheral surface thereof, the second circumferential groove forming the second pinch face.

2. The apparatus according to claim 1, wherein said arcuate cross section is semi-circular.

3. The apparatus according to claim 1, which further comprises second deflecting means for further continuing to subject the accelerated rod member to the transverse kinetic component, said deflecting means including a third rotating member arranged in parallel with said first rotating member and rotatable in the same direction with the first rotating member, and a second push face formed on part of the peripheral surface of the third rotating member, said second push face being adapted to force out the accelerated rod member continuously in the transportation direction of the second transportation path as the third rotating member rotates.

4. The apparatus according to claim 3, wherein the third rotating member is arranged on the down stream side of said first rotating member with respect to the first transportation path.

5. The apparatus according to claim 4, wherein said second deflecting means further includes a guide face formed on part of the peripheral surface of the third rotating member and adapted to support the rod member in cooperation with the first pinch face of the first rotating member when the rod member is accelerated by the first and second pinch faces.

6. The apparatus according to claim 5, wherein said third rotating member has a third circumferential groove with an arcuate cross section on the peripheral surface thereof, the third circumferential groove forming the guide face and the second push face.

7. The apparatus according to claim 1, which further comprises adjusting means for adjusting the distance between said first and second rotating members.

8. The apparatus according to claim 3, which further comprises adjusting means for adjusting the distance between said first and second rotating members, said adjusting means including first moving means capable of moving the second rotating member toward and away from the first rotating member and second moving means capable of moving the first and second rotating members entire in a direction crossing the first transportation path.

9. The apparatus according to claim 8, which further comprises second adjusting means for adjusting the distance between said first and third rotating members, said second adjusting means including third moving means capable of moving the third rotating member toward and away from the first rotating member.

10. The apparatus according to claim 9, wherein said second adjusting means further includes fourth moving means capable of moving the third rotating member in a direction crossing the first transportation path.

* * * * *